United States Patent [19]

Sykes

[11] Patent Number: 4,587,821

[45] Date of Patent: May 13, 1986

[54] WIRE FORMING MACHINE

[76] Inventor: Willard D. Sykes, 5613—152nd St. North, Hugo, Minn. 55038

[21] Appl. No.: 693,378

[22] Filed: Jan. 22, 1985

[51] Int. Cl.[4] ..... B21F 3/02

[52] U.S. Cl. ..... 72/137; 72/138

[58] Field of Search ..... 72/131, 135, 137, 138, 72/140; 140/71 R, 103

[56] References Cited

U.S. PATENT DOCUMENTS

| | | | |
|---|---|---|---|
| 2,073,343 | 3/1937 | Heilman | 72/138 |
| 2,077,243 | 4/1937 | Leal | 140/79 |
| 2,149,941 | 3/1939 | Prentice | 153/67 |
| 3,025,889 | 3/1962 | Clay | 140/71 |
| 3,025,890 | 3/1962 | Clay | 140/71 |
| 3,342,052 | 9/1967 | Boy | 72/138 |
| 3,402,584 | 9/1968 | Cavagnero | 72/138 X |
| 3,405,742 | 10/1968 | Guenther | 140/103 |
| 3,576,120 | 4/1971 | LeVasseur | 72/138 X |
| 4,030,327 | 6/1977 | Collins et al. | 72/23 |
| 4,112,721 | 9/1978 | Takase et al. | 72/12 |
| 4,211,100 | 7/1980 | Sykes | 72/131 |
| 4,296,621 | 10/1981 | Ohdai et al. | 72/137 X |

*Primary Examiner*—E. Michael Combs

*Attorney, Agent, or Firm*—Leo Gregory

[57] ABSTRACT

A wire forming machine in which the coil forming deflection tools are mounted on carriages and have one position to form a coil of a preset diameter and are automatically moved to a second position to continue forming the coil with a second diameter and in which one deflection tool having a tiltable head portion is arranged to be positioned automatically to form a true square corner by overbending the wire engaged.

4 Claims, 4 Drawing Figures

WIRE FORMING MACHINE

BACKGROUND OF THE INVENTION

1. Field of Invention.

This invention relates to a coiled wire spring forming machine.

2. Description of the Prior Art.

Prior art wire forming machines as known require setting up to form coil springs having a change in diameter and separate operations are required to form springs of different diameters. Further a separate finishing operation is required to form a square bend in a spring.

It is desirable to provide a coil spring forming machine in which in a continuous wire feeding operation coil springs may be formed having more than one diameter and in which true right angles or square bends may be formed.

SUMMARY OF THE INVENTION

The invention herein represents substantial improvement over prior art machines in having the capability of forming coiled springs which embody more than one diameter, the same being formed in a continuous operation and included in said continuous operation is the capability of making true right angled bends.

It is an object of this invention therefore to provide a wire forming machine constructed and arranged to form a continuous run of coil springs which may embody more than one diameter.

It is another object herein wherein wire forming deflection tools are mounted onto carriages and automatically actuated hydraulic means actuate said carriages to position their respective deflection tools to form more than one diameter in a spring being coiled.

It is a further object of the invention herein in view of the above object to form right angled or square bends in coiling wire springs in a continuous operation in which coil springs having more than one diameter may be formed.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a view in front elevation having some portions broken away;

DESCRIPTION OF A PREFERRED EMBODIMENT

Figure 2:
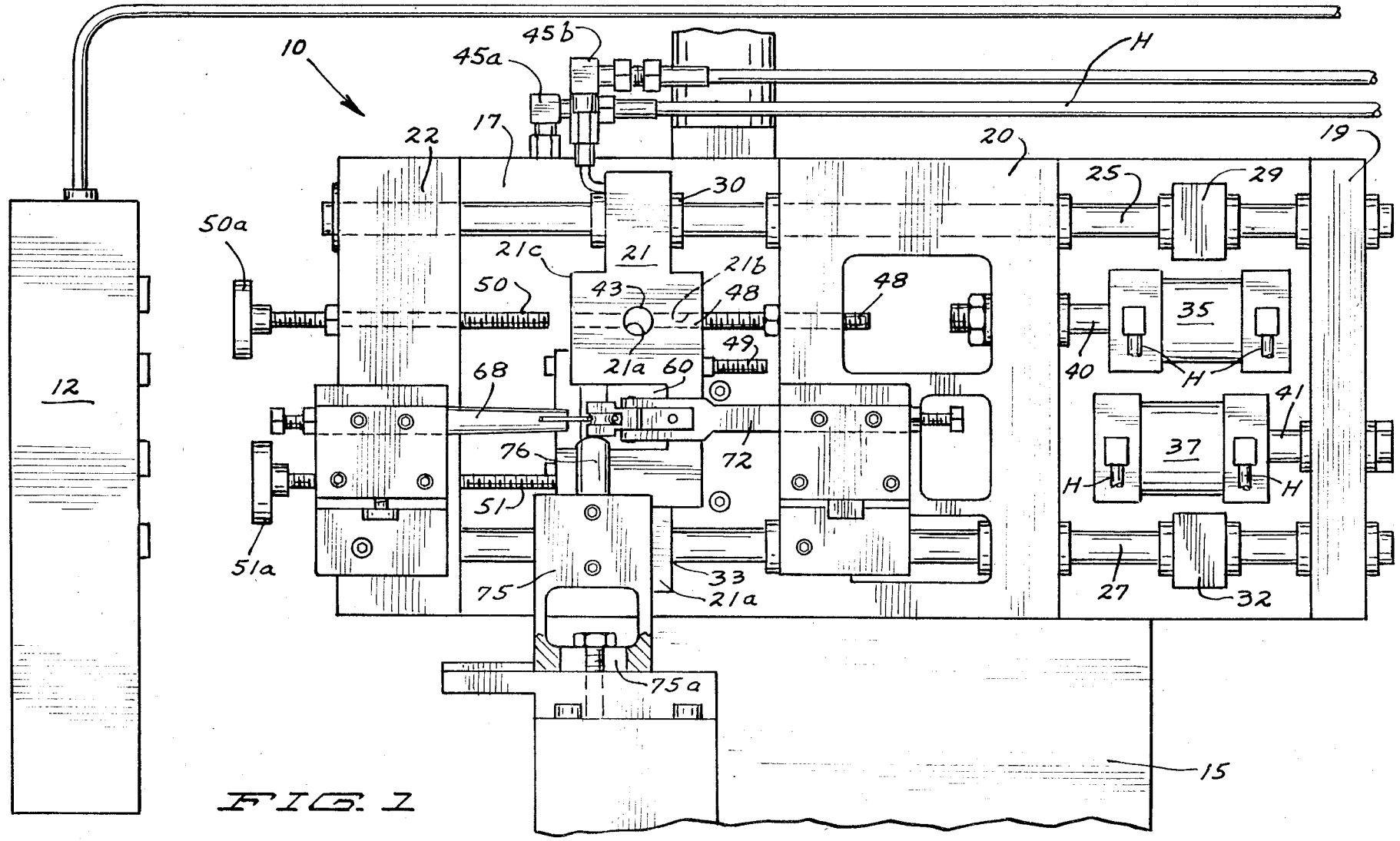
FIG. 2 is a top plan view with some portions broken away.
Figure 2:
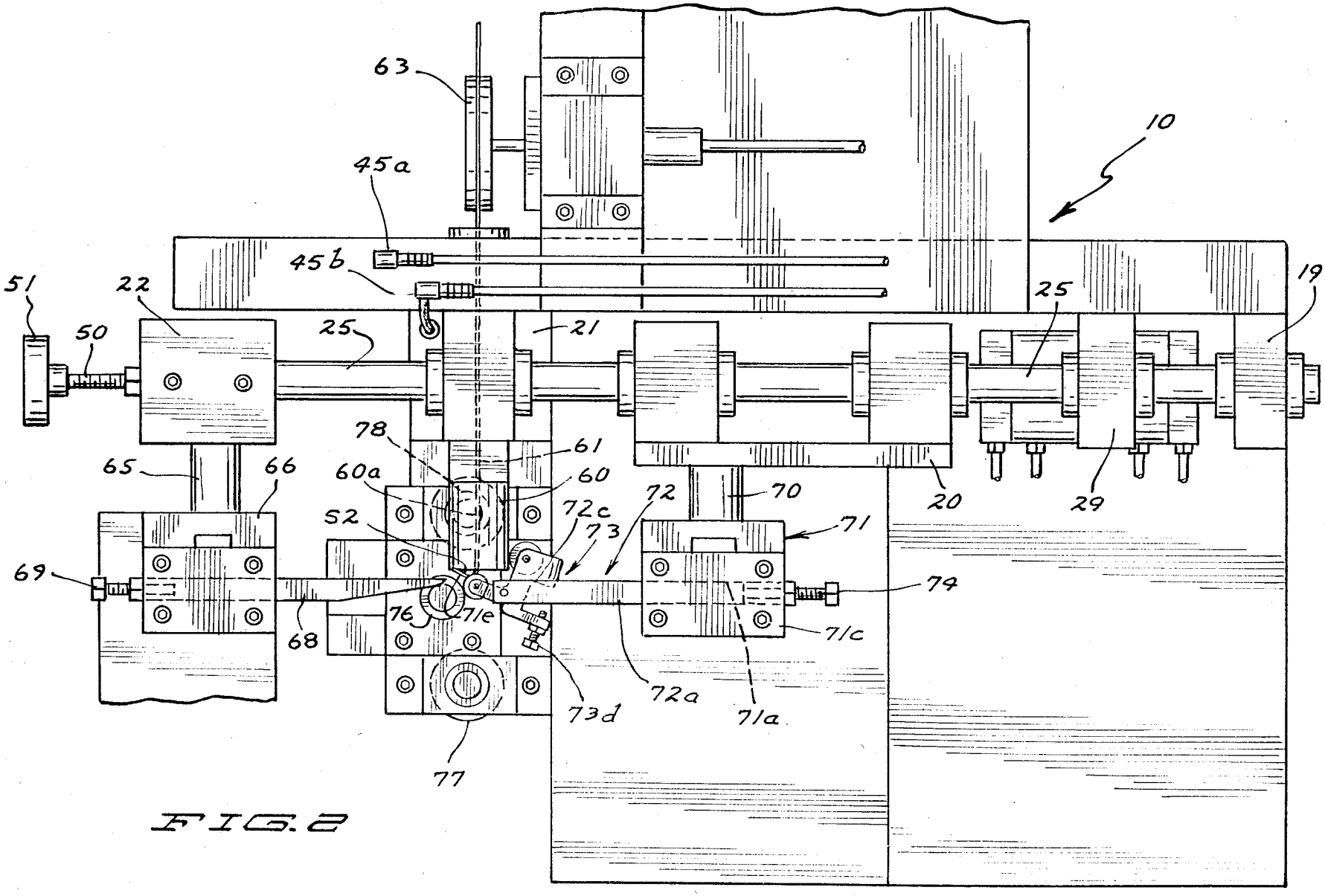

The structure disclosed herein is that part of a wire forming machine particularly adapted to form wire into springs, and more specifically, into coil springs.

For the remainder of the structure of the wire forming machine herein and for a description of structure to support and to cause the operation of the structure herein disclosed, reference is made to the applicant's U.S. Pat. No. 4,211,100 dated July 8, 1980 and the structure and description thereof in said patent referred to herein is embodied herein by reference.

The wire forming structure herein described is referred to generally by the reference numeral 10 and the control means thereof is indicated by the reference numeral 12. Said control means is a conventional incremental digital electronic count control device which corresponds to the device 31 of said patent, operates as described in said patent and is hereafter referred to as a console.

The electric and hydraulic power sources are not here shown except by reference to said patent and will correspond to the electric motor 43 and the hydraulic pump 48 and their related elements as described in said patent. The wire feeding elements which will be briefly shown correspond to like elements as shown in FIGS. 1 and 5 of said patent and as described in column 6 thereof in the paragraph commencing on line 26.

Referring to FIG. 1 hereof is the broken top surface 15 of supporting base or table member, not here shown, and upstanding from said surface is a supporting wall 17 upon which is mounted structure to be described.

Disposed at the right end portion of said wall, as viewed in FIG. 1, is a movable tool mounting block 19 extending the height of said wall; spaced therefrom somewhat centrally of said wall is a movable block 20; spaced to the left of said block 20 is a stationary tool mounting block 21 and at the left end of said wall is a movable block member 22. Said block 20 is formed as a frame having pockets or recesses therein as illustrated.

Extending through said blocks 19–22 are upper and lower shafts 25 and 27. Said shaft 25 is journaled in and supported by a bearing box 29 anchored to said wall and is journaled in end supported by the bearing 30 formed in the mounting block 21. In a like manner the lower shaft 27 is journaled in a bearing box 32 and in a bearing indicated at 33 formed in a lower extension **21*a* of the mounting block 21**.

Said shafts are disposed through the blocks 19–22 and are secured to the blocks 19 and 22. In effect said shafts and said blocks form a frame which has unitary movement. The block 20 is slidable upon said shafts. Surfaces having relative movement will be formed to have suitable bearing surfaces.

Mounted upon said wall 20 are a pair of hydraulic valves 35 and 37 respectively having ports A and B through which by hydraulic fluid are actuated respectively the pistons 40 and 41. Said pistons are respectively connected to the blocks 20 and 19 in a conventional manner as indicated in FIG. 1.

All hydraulic lines herein are indicated by the reference letter H and all will be suitably connected in a conventional manner to a hydraulic pump corresponding to the pump 48 of said patent and corresponding to the description given in said patent.

Figure 4:
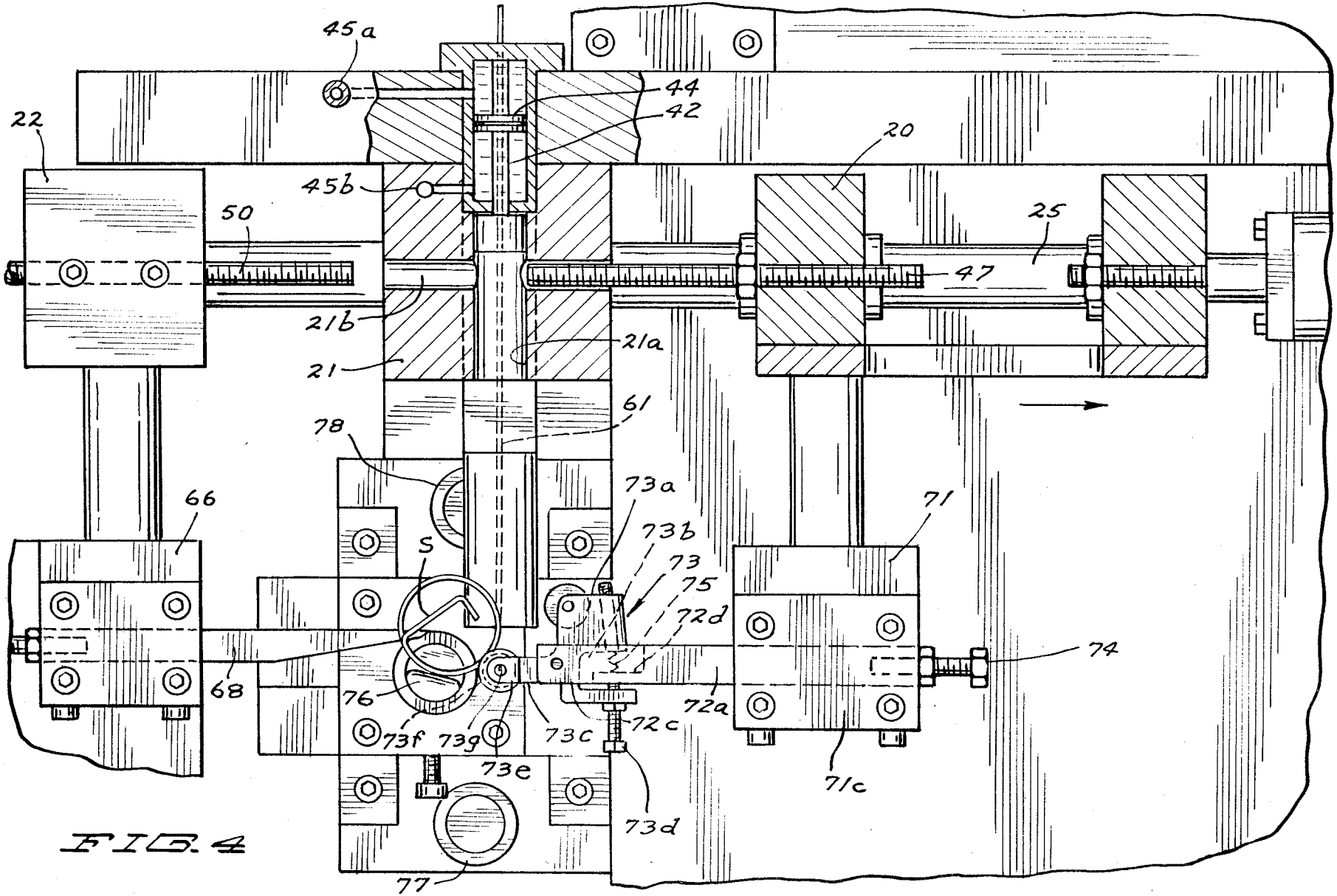
FIG. 4 is a view to FIG. 3 showing still another operating position.

Disposed in a horizontal bore **21*a* of the block 21 is a cylinder 42, as shown in section in FIG. 4, having therein a piston 44 which is activated by hydraulic lines H through the ports 45*a* and 45*b***. This structure will be further described.

Said block 21 has a transverse bore **21*b* therethrough as shown in dotted line in FIG. 1 and in the sectional view of FIG. 4**.

Carried by the block 20 is a threaded rod 47 which forms a stop member to determine the travel distance of the block 20. As seen, said rod is adjustable axially to determine its outward extension of block 20 and said rod is aligned with said bore 21*b* and extends therein as will be described. Carried by the block 21 is a threaded rod stop member 49 extending in the direction of the block 20 to limit its movement.

The block 22 has a threaded rod 50 extending horizontally therethrough carrying at its outer end a hand wheel 50*a*. Said rod forms a stop member and is positioned to be aligned with the bore 21*b* of said block 21 to determine the travel distance of the block 22. An external threaded rod stop member 51 is carried by said block 22 having an adjusting handwheel 51*a*.

Mounted onto said block 21 is a quill 60 being appropriately apertured as indicated at 60*a* to have a spring forming wire 61 fed therethrough as by wire feeding member 63 (FIG. 2) which is intended to merely indicate the wire feeding apparatus as described in said patent.

Connected to said block 22 by a shaft 65 is a tool mounting carriage 66 particularly adapted to removably carry either a wire forming deflection tool or as here illustrated, a wire cutting tool 68 and having in connection therewith an adjustable positioning screw 69.

Connected to the block 20 by means of a shaft 70 is a carriage 71 carrying a wire forming deflection tool 72 having in connection therewith an adjusting screw 73. This particular deflection tool, as here illustrated, will be later described.

Underlying the forwardly projecting portion of said quill is a carriage 75 carrying a vertically disposed wire deflection tool 76. As indicated at 75*a*, said carriage may be adjusted laterally to position said tool 76. Said carriage 75 has vertical adjustment by means of a pair of hydraulic cylinders, as indicated at 77 and 78, in a conventional arrangement having appropriate hydraulic hoses running to a hydraulic pump in the manner as indicated in said patent.

It is to be understood that wire forming deflection tools and wire cutting tools are interchangeable as to position.

Shown carried by the carriage 71 is the wire forming deflection tool 72 which is particularly adapted to form true right angled or square corners. Said tool is some times characterized as being a knuckle tool.

Said tool 72 comprises a shank 72*a* received into the accommodating recess 71*a* of said carriage 71 positioned by the stop member 74 and secured by tightening the top plate 71*c*.

The tool 72 as here illustrated is shown having a stepped bifurcated end portion 72*c* having an inner lower shelf 72*d* therein. Disposed into said bifurcated portion is a tiltable wire deflecting member 73 having an upper body portion 73*a* having an open sided slot 73*b*, said body portion fitting into said bifurcated portion 72*c* to have a portion thereof underlie said shelf 72*d* and depending therefrom is an adjustable threaded stop member 73*d* which engages the adjacent bottom of said shelf 72*d*.

A forwardly projecting portion 73*c* of said member 73 is bifurcated at 73*e* to carry a roller 73*f* secured by a pin 73*g*. Said roller is shown having an annular groove 73*h*.

Said upper body portion 73*a* is slotted to carry a roller 73*i* journaled on a pin 73*k* and a rearward portion thereof overlies said shelf 72*d*. A coil spring 75 is seated upon said shelf within said cut out portion 73*b* and urges said member 73 to tilt upwardly pivoted by a pin 71*e*.

The operation of said tool will be described hereinafter.

OPERATION

The structure disclosed herein is particularly adapted to have the capability in a continuous operation of forming coil springs having more than one diameter and including the forming of square corners where desired.

As has been indicated, embodied herein by references are the operation of the console 31, the motor 43, the hydraulic pump 48, and the wire feeding elements as set forth in the applicant's U.S. Pat. No. 4,211,100.

The wire 61 will be fed continuously through the quill 60.

For purpose of description herein, the tool 68 is shown to be a wire cutting tool, the tool 76 is shown to be a wire deflection coiling tool and the tool 72 is a wire deflection coiling tool having the capability of making square corners as will be described.

It will be understood that the size of the coil diameter of a spring being coiled is determined by the distance of the head of a deflection tool from the wire outlet aperture 60*a* in the quill through which wire is fed.

The control panel 12 is preset to determine the length and form of the spring to be formed in connection with the encoder 36 of said patent, said encoder being one of the wire feeding elements.

The operation herein will commence with the apparatus being energized and operating.

The hydraulic valve 35 by means of its piston 40 causes the transverse movement of the block 20 to position the deflection tool 72 to engage and coil the wire 61 being fed through the quill 60. At this point for purpose of description, by means of the hydraulic lines 45*a* and 45*b*, as operated by the hydraulic pump embodied herein by reference, the cylinder 42 will be projected into the bore 21*a* to block the transverse passage 21*b* and form a stop for the stop member 47 of the block 20. This arrangement provides the springs S being formed with one diameter.

To provide a second diameter in the springs being formed, use herein will be made of the deflection tool 76. Said tool will be preset regarding its operating relationship to said quill 60 with respect to forming a coil of a specified diameter and in accordance with the setting established on the console 12, when a preset length of each spring being formed has been coiled, through the valve 35, the block 20 will be retracted and the carriage 75 will be raised to appropriately position the tool 76 and, without interruption of the continuous feed of the wire 61, coiling will continue with a larger or smaller diameter, however the presetting was arranged.

When the preset length of the wire has been coiled, the carriage 75 will be retracted and the hydraulic valve 37 will be caused to urge the blocks 19 and 22 to move the cutting tool 68 into engagement with the wire being formed to cut off the same and thereupon the cycle of operation just described is repeated.

In the event a square corner is desired to be formed in any preset portion of the spring being formed, the following occurs as a result of preset programming at the console.

Figure 3:
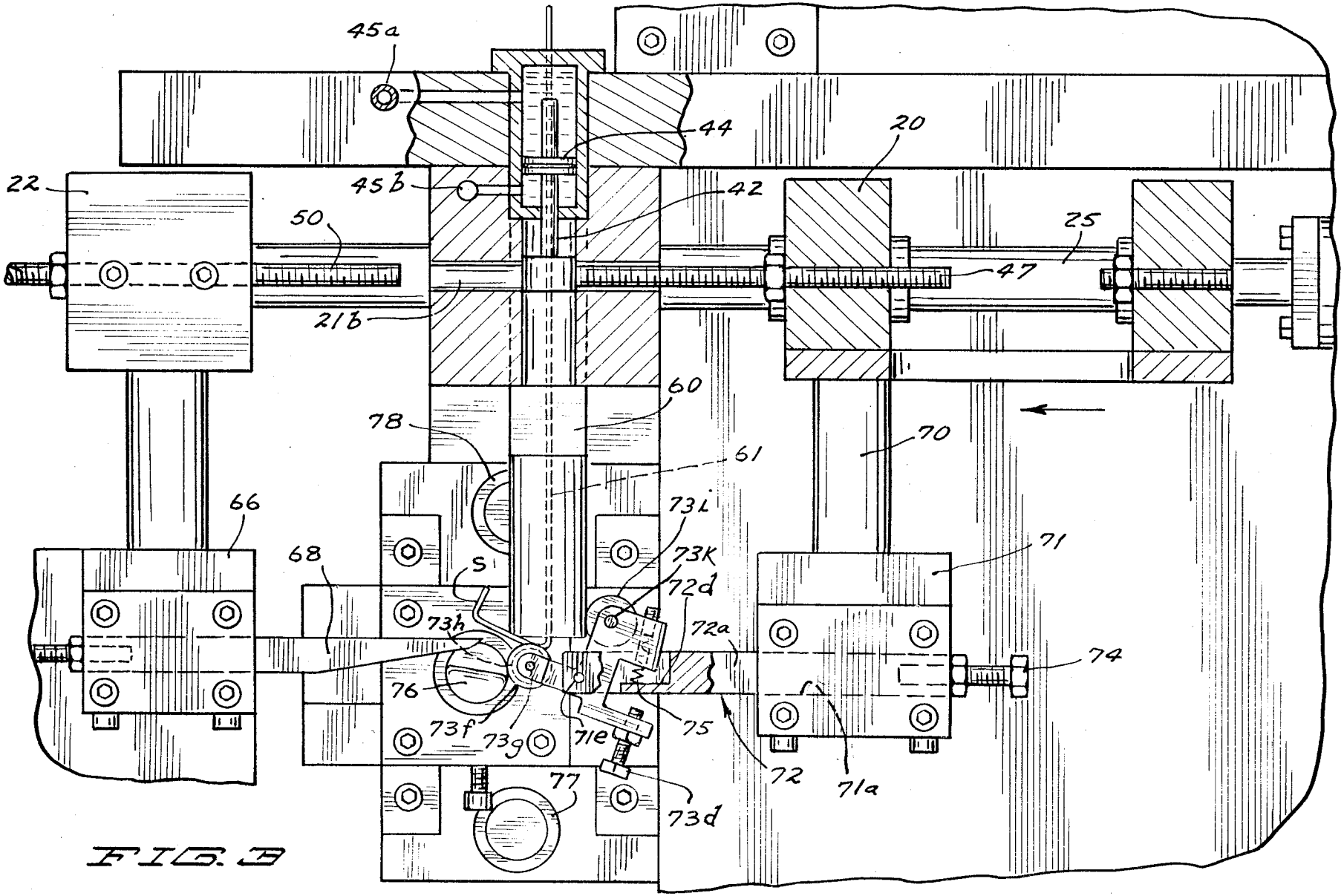
FIG. 3 is a view similar to FIG. 2 having some portions in section and showing a different operating position.

At the position in the forming of a coil spring at which it is desired to form a square corner, any tool in coiling position with regard to the quill 60 will be withdrawn, other than the tool 72, and to position the tool 72 to make a square corner, the cylinder 42 will be retracted by means of the hydraulic valve 45 which unblocks the passage 21*b* for the further advance of the stop member 47 therein to the point of being stopped by the stop member 49. In the process of being moved to the left, as illustrated in FIGS. 2 and 3, the roller 73*f* is in such close proximity to the quill that in moving across its face, it causes an acute bend of the wire 61 as indicated at S2 in FIGS. 2 and 3. A completed bend S1 is shown in FIG. 3. The square corner shown is formed by overbending. Thus as the roller 73*f* engages the wire 61 to form a bend, the roller 73*i* engages the adjacent side of the quill 60 and causes the deflecting head 73 to tilt urging the roller 73*f* to overbend the spring wire into an acute angle whereby when the pressure of said roller 73*f* is removed. The bend thus formed partially restores itself to result in a true or square right angle as shown at S1. The advance of the wire being fed is so rapid that there results no appreciable break in time in positioning and repositioning the deflection and cut off tools and in forming a square corner. The spring wire 61 can be advanced on the order of 1800 feet per minute and the structure described herein readily accommodates such speed.

It will be understood that the deflection and cut off tools may be variously arranged to secure the results described. A two diameter coil spring may be formed by a deflection tool mounted onto the block 22, forming one diameter in being stopped by the cylinder 42 and forming a smaller diameter by having the cylinder 42 retracted and being stopped by the member 51, which would position the deflecting tool closer to the aperture 60*a* of the quill through which wire is fed. The square bending tool 72 as described may be mounted on either the carriage 66 or 71. The deflection tool 76 may be replaced by the cutting tool 68.

Thus it is seen that there is provided a very efficient wire coiling apparatus resulting from the unique construction and arrangement of deflecting tools and the unique high speed positioning of said tools providing the capability of making coil springs having more than one diameter and of forming true square corners.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A wire forming machine including wire feeding means, wire forming means, means operating said wire feeding means, means operating said wire forming means and a console controlling the operation of said wire feeding and wire forming means, in which improvement in connection with said wire forming means consists of a quill a supporting framework having said quill mounted thereon, means feeding wire through said quill, a first carriage, means mounting said first carriage upon said framework and moving said carriage toward and away from said quill, a wire engaging tool carried by said carriage, a second carriage, means mounting said second carriage upon said framework and moving said second carriage toward and away from said quill, a wire engaging tool carried by said second carriage, a third carriage, means mounting said third carriage upon said framework and moving said third carriage toward and away from said quill, a wire engaging tool carried by said third carriage, a stop member carried by said first carriage, stop means engaged by said stop member limiting the movement of said first carriage, said stop means comprises a block member carried by said framework a bore through said block member parallel to the passage through said quill, a cylinder disposed in said bore, a second bore through said block intersecting said first mentioned bore and being in alignment with said stop member of said first carriage and receiving the same therein, and means causing said cylinder to move through said bore to intersect said second bore, whereby said cylinder forms a stop in said second bore for said stop member of said first carriage.

2. The structure of claim 1, wherein said wire engaging tool carried by said first carriage comprises a shank carried in said carriage, a pivoted head portion extending from said shank, a wire engaging member carried by said head portion, said means moving said first carriage unto such close proximity to said quill as to cause said wire engaging member to form a square corner of said wire being fed therethrough, and means carried by said head portion in a continuing movement of said carriage engaging said quill and tilting said head portion of said shank to cause said wire engaging member to over bend said wire into less than a square corner whereby when said wire engaging member is withdrawn from engagement with said wire, said wire restores itself to form a square corner.

3. The structure of claim 1, wherein said cylinder is intersected with and withdrawn from said second bore by said cylinder moving means responsive to the movement of said first carriage whereby said first carriage is stopped in a first or second stop position to cause the wire engaging tool carried thereby to cause wire fed through said quill to be formed in coils having more than one diameter.

4. A wire forming machine including wire feeding means, wire forming means operating said wire feeding means, means operating said wire forming means and a console controlling the operation of said wire feeding and wire forming means, in which improvement in connection with said wire forming means consists of a supporting framework, a quill carried by said framework, means feeding wire through said quill, a carriage, means mounting said carriage upon said framework and moving said carriage toward and away from said quill, a wire engaging tool, means mounting said wire engaging tool upon said framework, said wire engaging tool comprising, a shank secured to said carriage, a wire engaging head portion extending from said shank, means adjustably pivotally securing said portion to said shank, said carriage moving means moving said head portion into such close proximity to said quill as to engage and cause said wire fed through said quill to form a square corner and means carried by said head portion engaging said quill causing said head portion in a continuing action to tilt causing said wire to form less than a square corner under pressure, whereby when said head portion is disengaged from said wire, said wire restores itself to a square corner.

* * * * *